United States Patent [19]

Wilkinson

[11] Patent Number: 4,955,205

[45] Date of Patent: Sep. 11, 1990

[54] METHOD OF CONDITIONING BUILDING AIR

[75] Inventor: William H. Wilkinson, Columbus, Ohio

[73] Assignee: Gas Research Institute, Chicago, Ill.

[21] Appl. No.: 445,987

[22] Filed: Dec. 4, 1989

Related U.S. Application Data

[62] Division of Ser. No. 302,428, Jan. 27, 1989, Pat. No. 4,905,479.

[51] Int. Cl.[5] ..... F25D 17/08

[52] U.S. Cl. ..... 62/94; 55/20; 55/31; 55/32; 62/176.4

[58] Field of Search ..... 62/271, 94, 171, 176.4; 55/20, 31, 32

[56] References Cited

U.S. PATENT DOCUMENTS

| | | | |
|---|---|---|---|
| 1,518,162 | 12/1924 | Parkinson | 62/271 |
| 2,257,478 | 9/1941 | Newton | 62/271 |
| 2,262,954 | 11/1941 | Mattern et al. | 62/271 |
| 2,269,053 | 1/1942 | Crawford | 62/271 |
| 2,355,828 | 8/1944 | Taylor | 62/271 |
| 2,525,045 | 10/1950 | Richardson | 62/271 |
| 2,557,204 | 6/1951 | Richardson | 62/271 |
| 2,690,656 | 10/1954 | Cummings | 62/271 |
| 2,744,733 | 5/1956 | Howes | 62/271 |
| 2,981,078 | 5/1961 | Fairbairn | 62/271 |
| 3,102,399 | 9/1963 | Meckler | 62/271 |
| 3,153,914 | 10/1964 | Meckler | 62/271 |
| 3,247,679 | 4/1966 | Meckler | 62/271 |
| 3,401,530 | 9/1968 | Meckler | 62/271 |
| 3,488,971 | 1/1970 | Meckler | 62/271 |
| 4,011,731 | 3/1977 | Meckler | 62/271 |
| 4,164,125 | 9/1979 | Griffiths | 62/271 |
| 4,171,620 | 10/1979 | Turner | 62/271 |
| 4,171,624 | 10/1979 | Meckler et al. | 62/271 |
| 4,222,244 | 9/1980 | Meckler et al. | 62/271 |
| 4,259,849 | 4/1981 | Griffiths | 62/271 |
| 4,577,471 | 3/1986 | Meckler | 62/271 |
| 4,635,446 | 1/1987 | Meckler | 62/271 |
| 4,691,530 | 9/1987 | Meckler | 62/271 |
| 4,723,417 | 2/1988 | Meckler | 62/271 |

*Primary Examiner*—William E. Tapolcai

*Attorney, Agent, or Firm*—Watkins, Dunbar & Pollick

[57] ABSTRACT

A hybrid air conditioning system for an enlcosed space in a building is comprised of a refrigeration subsystem handling the enclosed space sensible heat load and of a liquid desiccant dehumidification subsystem handling the enclosed space latent heat load. The dehuymidification subsystem primarily utilizes available heat from the refrigeration subsystem for liquid desiccant regeneration and dehumidifies ventilation air from the ambient atmosphere for subsequent mixing with enclosed space recirculated air to control the relative humidity within the enclosed space to a desired level. Total system performance efficiency is improved by a novel method of operation of system elements.

4 Claims, 7 Drawing Sheets

METHOD OF CONDITIONING BUILDING AIR

CROSS REFERENCE

This application is a division of co-pending U.S. Patent Application Ser. No. 07/302,428, filed Jan. 27, 1989, now U.S. Pat. No. 4,905,479.

The present invention relates generally to air conditioning, and particularly concerns an improved method for reducing the temperature and relative humidity of air circulated within an enclosed space such as a building interior.

BACKGROUND OF THE INVENTION

Numerous applications of desiccant dehumidification to the conditioning of air are known in the prior art. U.S. Pat. Nos. 3,401,530 and 3,488,971 TO Meckler, and U.S. Pat. No. 4,164,125 to Griffiths, for instance, utilize a solid desiccant for the application. Similarly, U.S. Pat. No. 4,011,731 to Meckler, and U.S. Pat. No. 4,171,620 to Turner teach the use of a desiccant in the conditioning of air but emphasize the use of liquid desiccant and materials. Also, Meckler's U.S. Pat. No. 3,102,399 suggests a building air conditioning system wherein make-up ventilation air is subjected to liquid desiccant dehumidification in a two-stage dehumidification process to improve total system performance efficiency but he is forced to use a two-stage dehumidification process.

U.S. Pat. No. 4,171,624 to Meckler et al. teaches the use of thermal compressor means to regenerate or concentrate a dilute desiccant solution. Meckler also, in U.S. Pat. No. 4,222,244 for example, teaches the use of solar energy in desiccant regeneration for an air conditioning system. See also U.S. Pat. No. 4,577,471 to Meckler in the regard.

U.S. Pat. No. 4,259,849 to Griffiths also teaches the use of heat obtained from the condenser of a conventional vapor compression refrigeration system for effecting liquid desiccant regeneration.

U.S. Pat. No. 3,247,679 issued to Meckler discloses an engine-driven vapor compression refrigeration subsystem in a comfort conditioning system that also utilizes a liquid desiccant dehumidification subsystem. Meckler's U.S. Pat. No. 3,153,914 teaches air conditioning with a liquid desiccant dehumidification dehumidifier but without supplemental refrigeration.

U.S. Pat. No. 2,981,078 discloses air cooling and dehumidification and dehumidification using a hydroscopic agent and a rotating foraminous disk partially immersed in the agent. Supplemental absorption or mechanical refrigeration is not suggested.

U.S. Pat. No. 2,355,828 to Taylor discloses an earlier combined refrigeration and dehumidification air conditioning system.

U.S. Pat. No. 2,262,954 to Mattern, et al., discloses an air dehumidification system with controls to prevent desiccant crystallization during liquid desiccant regeneration. U.S. Pat. No. 2,557,204 to Richardson also teaches liquid desiccant regeneration in a manner that improves the reclamation of waste heat.

For other variations of air conditioning systems employing liquid desiccant solutions for dehumidification of air see U.S. Pat. Nos. 4,635,446, 4,691,530, and 4,723,417, all issued in the name of Meckler.

SUMMARY OF THE INVENTION

A building air conditioning system configured in accordance with the present invention is comprised of a refrigeration subsystem and a cooperating liquid desiccant dehumidifier subsystem. The refrigeration subsystem, in one embodiment of the invention, is an absorption chiller fueled by a natural gas energy source and modified to make reject heat hot enough for desiccant regeneration. In another embodiment of the invention the refrigeration subsystem is an engine-driven refrigerant vapor compressor fueled by a natural gas energy source, by way of example. Either such refrigeration subsystem provides necessary available heat to the liquid desiccant dehumidifier subsystem for the purpose of effecting or assisting in effecting liquid desiccant regeneration (dilute desiccant solution concentration) in the latter subsystem without penalizing the efficiency of the refrigeration subsystem.

The refrigeration subsystem is provided in the invention for the purpose of effecting air temperature variation and control by handling the system sensible heat load associated with air circulated within the building air conditioned, enclosed space. The liquid desiccant subsystem is provided in the invention for the purpose of effecting conditioned air relative humidity variation and control by handling the total system latent heat load associated with the air circulated within the building air conditioned, enclosed space. In the preferred embodiment of the present invention, building air-conditioned, enclosed space is continuously or very nearly continuously provided with fractional ventilation air from outside the enclosed space, and relative humidity control is effected by processing that ventilation air fraction through the liquid desiccant dehumidification subsystem to accomplish moisture removal from the processed air. The processed fractional ventilation air is the combined (mixed) with air recirculated from the enclosed space and the resulting mixed air is lowered in temperature by the air conditioning system refrigeration subsystem.

To achieve an improved coefficient of performance for the total system, and also to achieve economic advantages by way of reduced equipment acquisition costs and by way of reduced operating fuel or energy costs, I utilize available heat from the refrigeration subsystem to effect, at least in part, liquid desiccant regeneration in the liquid desiccant dehumidification subsystem portion of the total air conditioning system. Such available heat is sometimes characterized as reject heat. Additionally, particular cooling tower and air-to-air heat exchanger components are advantageously incorporated into such liquid desiccant dehumidification subsystem to further improve air conditioning system performance.

The foregoing and other advantages of the invention will become apparent from the following disclosure in which a preferred embodiment of the invention is described in detail and illustrated in the accompanying drawings. It is contemplated that variations and structural features and arrangement of parts may appear to the person skilled in the art, without departing from the scope or sacrificing any of the advantages of the invention which is delineated in the included claims.

DETAILED DESCRIPTION OF THE INVENTION

For applications such as supermarkets, which typically have high latent loads and high ventilation rates, the ability of solid desiccant systems to shift portions of the cooling load directly to the ambient and to maintain lower humidity levels around cold display cases has reduces energy consumption significantly (Cohen et al, 1984, "Field Development of a Desiccant-Based Spaced-Conditioning System for Supermarket Applications", GRI Final Report, Feb. 1982–June 1984, NTIS N. PB85-101921, Chicago, Ill.). In addition, consumer comfort has been improved. Liquid desiccant systems, on the other hand, have been particularly successful in special applications like hospitals, nursing homes, and animal laboratories, providing not only improved humidity control but also bacterial control. General use of hybrid liquid desiccant systems has not yet occurred, partly because of the perceived complexity of these systems and, possibly, because of their classification as being of use only in "special case" applications. One of the objectives of this invention is to define a simple hybrid system that would be broadly applicable to a wide range of building situations. Such universal usefulness has promise for changing the standards for acceptable building environments.

Figure 1:
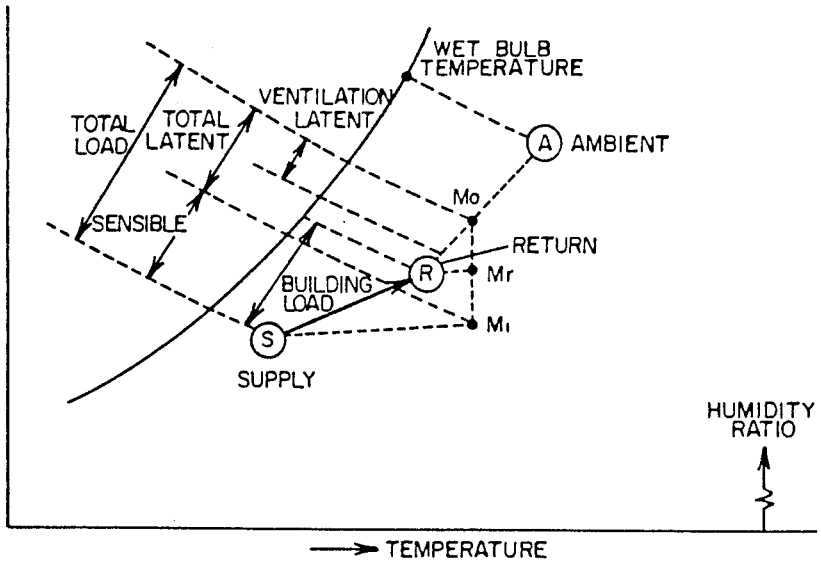
FIG. 1 is a psychrometric chart representation of a typical building air conditioning load including the loads generated by air recirculated within the building and by ventilation air combined with recirculated air.

FIG. 1 shows a psychrometric representation of a typical building load, including the load generated within the building and the load of the ventilation air needed to maintain a healthy building environment. The building load, the enthalpy difference from S to R, represents the sum of both sensible load and latent load. The ambient ventilation air imposes an additional load with a large latent content as it is brought from A to R on FIG. 1. Because ventilation flow is only a portion of the total supply air to the conditioned space, an effective mixing point, $M_o$, is constructed so that the enthalpies derived from the psychrometric chart can be used to represent the total load. The total sensible load is represented by the enthalpy difference between points $M_1$ and S. The total latent load is represented by the enthalpy difference between points $M_o$ and $M_1$ as shown. It should be noted that, even if the building has no latent load, the total system load would still have a significant latent content because of the required ventilation. The latent load imposed by the ventilation air is represented by the enthalpy difference $M_o - M_r$ on FIG. 1.

Figure 2:
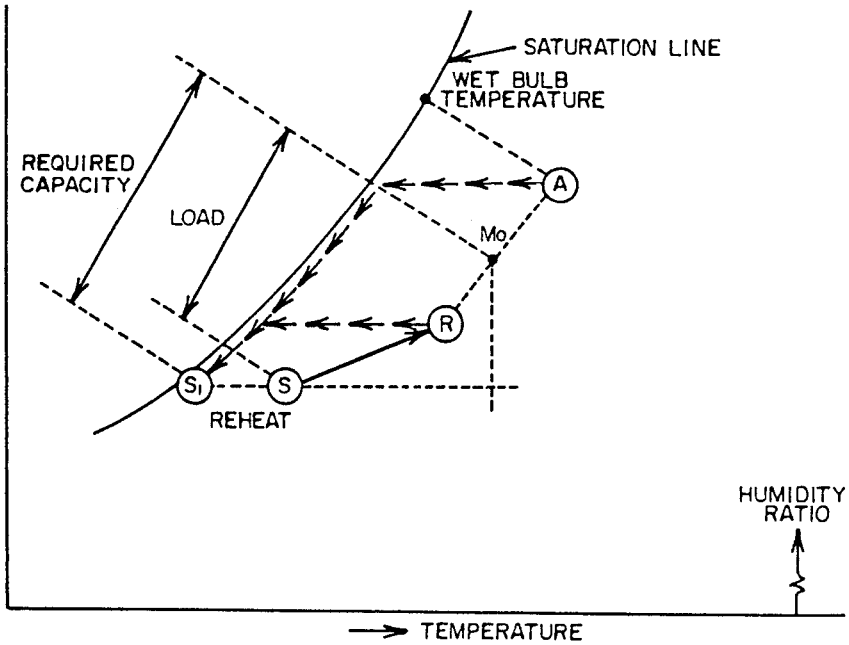
FIG. 2 is a psychrometric chart representation of a typical building air conditioning system conventional load illustrating the increased cooling capacity required by reheat.

As shown in FIG. 2, a conventionally cooled building would have the airstreams cooled to their dew points and then further cooled to a lower dew point as additional moisture is condensed out the air. It is thermodynamically unimportant whether this occurs in two separate heat exchangers, as impled by the process lines shown, or whether the ventilation air and the return air are mixed before being cooled. To maintain desirable humidity control, the air at $S_1$ is too cold for supply to the conditioned space, so the air supply is reheated (beyond the heat supplied by the fans) from $S_1$ to S. Since this reheat is seldom obtained by recuperative heat transfer with any of the airstreams, the actual chilling capacity of the chiller must exceed the nominal load of the installation as indicated.

Figure 3:
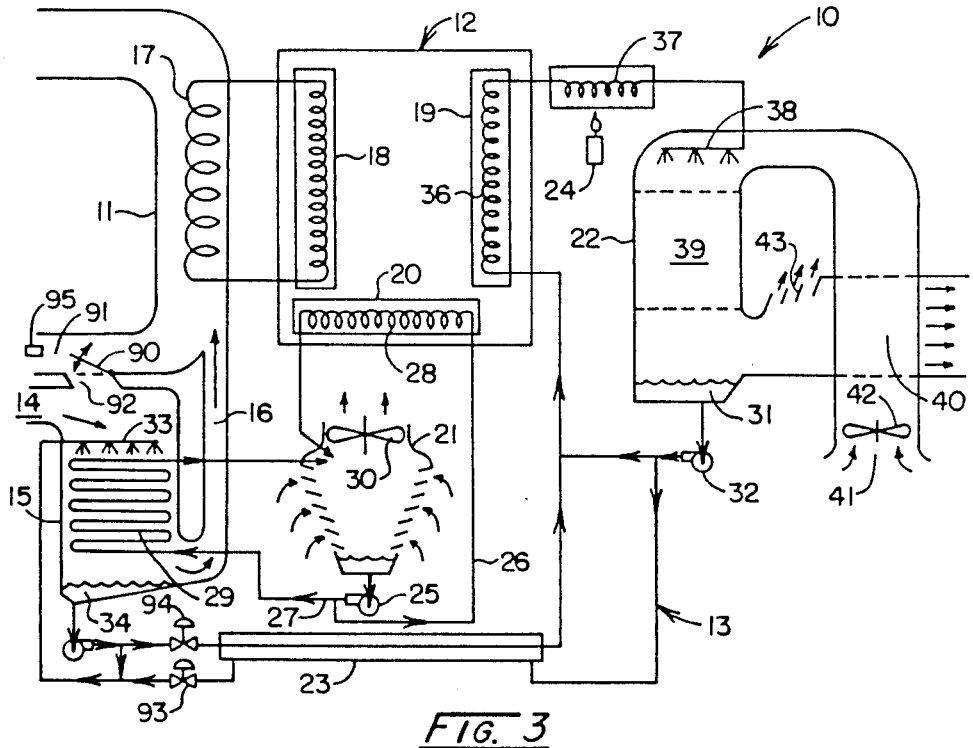
FIG. 3 is a schematic illustration of one embodiment of the apparatus and method of this invention having an absorption refrigeration subsystem and a cooperating liquid desiccant dehumidification subsystem.

FIG. 3 schematically illustrates a preferred embodiment 10 of the building air conditioning system of this invention. Such system includes in part, air distribution ductwork 11 that recirculates air returned from within enclosed space for reconditioning which typically involves cooling and a lowering of air relative humidity. Cooling is accomplished in system 10 by absorption chiller refrigeration subsystem 12 and dehumidification is accomplished by liquid desiccant dehumidification subsystem 13. Subsystem 13 processes fractional ventilation air received from the system ambient atmosphere at inlet 14 and a controlled portion of the return air as diverted from return duct 91 by damper 90 through connecting duct 92 to dehumidifier inlet 14. Such ventilation air, after processing in the dehumidifier portion 15 of subsystem 13 for dehumidification, is flowed by way of duct 16 to distribution ductwork 11 for mixing with the remaining return air and for cooling by heat exchanger (cooling coil) 17. Heat exchanger 17 circulates chilled water received from refrigeration subsystem 12.

Refrigeration subsystem 12, which takes the form of an absorption chiller in FIG. 3, typically includes, inter alia, an evaporator heat exchanger component 18, a condenser heat exchanger component 19, and an absorber heat exchanger component 20. Also, such typical absorption chiller subsystem includes an energy or heat source, such as a natural gas burner (not shown in the drawings). Further, refrigeration subsystem 12 may be provided in the form of a double-effect absorption subsystem rather than a common single-effect subsystem. Components 13–20 function to evaporate, condense, and re-absorb refrigerant from an absorption refrigerant pair such as a lithium bromide and water solution. The refrigerant passed through the absorption refrigeration subsystem evaporator heat exchanger 18 cools or chills water that is circulated separately through cooling coil 17 situated in distribution ductwork 11 to effect temperature changes in the combined recirculated and ventilation airflows.

The cooling tower 21 cooperates with the absorption system through the absorber heat exchanger 20 and with the liquid desiccant dehumidification subsystem 13 through heat exchanger 29 in the dehumidifier 15. The liquid desiccant dehumidification subsystem 13 cooperates with absorption chiller refrigeration subsystem 12 through condenser exchanger component 20. The liquid desiccant subsystem 13 is principally comprised of dehumidifier 15, desiccant regenerator 22, heat exchanger 23, auxiliary burner 24, and various interconnecting pumps, coils, and lines as shown schematically in FIG. 3. The desiccant solution utilized in subsystem 13 is typically an aqueous solution of lithium chloride, lithium bromide, ethylene glycol, etc. As shown in FIG. 3, a valve 93 responsive to a conditioned space "humidistat" 95 is incorporated in the line from heat exchanger 23 to the dehumidifier spray 33 to regulate the addition of concentrated desiccant to the spray 33. A second valve 94 in the line from pump 35 to heat exchanger 23 regulates the flow of dilute liquid desiccant to the regenerator spray 38 and is responsive to the level of the liquid in the dehumidifier sump 34. This pair of valves 93 and 94, controls the concentration of the recirculated desiccant from pump 32 to coil 36. Another schematic illustration of the liquid desiccant dehumidification subsystem disclosed in FIG. 3 is provided in FIG. 10 of the drawings.

Cooling tower water is circulated from cooling tower 21 by pump means 25 through loops 26 and 27 having included cooling coils 28 and 29, respectively. Cooling coil 28 cooperates with refrigeration subsystem absorber heat exchanger 20; cooling coil 29 is the basic cooling coil produced in dehumidifier 15. Cooling tower 21 receives ambient atmosphere air circulated by cooling tower fan 30 for cooling tower water in counterflow relation. Total system coefficient of performance improvement is at least in part achieved through the effect of cooling tower water circulation through the dehumidifier 15.

In instances of the system operation in which it appears that the capacity of cooling tower 21 to handle the dehumidification load imposed on dehumidifier 15, it may become desirable to incorporate a heat exchanger (not shown) in the line between coil 17 and the coil of heat exchanger 18 and to use that additional heat exchanger to further cool the cooling water medium cooled by tower 21 and circulated through cooling coil 29.

A liquid desiccant such as a relatively concentrated lithium chloride solution 31 is flowed from the collector of desiccant regenerator 22 by means of circulating pump 32 to the sprayer 33 of dehumidifier 15. The concentrated (or "strong") desiccant solution is sprayed by sprayer 33 into the stream of ventilation air inducted through inlet 14 and reduces the water content of that ventilation air to the desired reduced level by absorption of the "excess" moisture into the desiccant solution thus causing the solution to become a diluted (or "weak") desiccant solution 34. The diluted desiccant solution 34 is circulated by pump means 35 through heat exchanger 23 in counterflow relation to regenerated (concentrated) desiccant solution flowed through that heat exchanger by pump means 32. The dilute desiccant solution is further flowed by pump means 35 through coil 36 which cooperates with refrigeration subsystem condenser heat exchanger 19 and also through coil 37 that cooperates with auxiliary burner 24. Afterwards, the heated desiccant relatively dilute solution is sprayed by sprayer 38 into liquid desiccant packed regeneration bed 39 situated in the ductwork of regenerator 22.

The air-to-air recuperative heat exchanger 40 provided in regenerator 22 provides both improved desiccant regeneration efficiency and system control. During periods of hot, dry, atmospheric conditions when little or no latent heat load exists, little desiccant regeneration is required; still the available heat for regeneration must be rejected and removed from the subsystem absorber 20 by cooling tower 21. By-passing air-to-air heat exchanger 40 in those ventilation air conditions by opening normally closed control louvers 43 allows for increased sensible heat transfer to the regeneration air introduced at ductwork inlet 41 by fan 42 and avoids excessive concentration of the liquid desiccant during the abnormal period.

Figure 4:
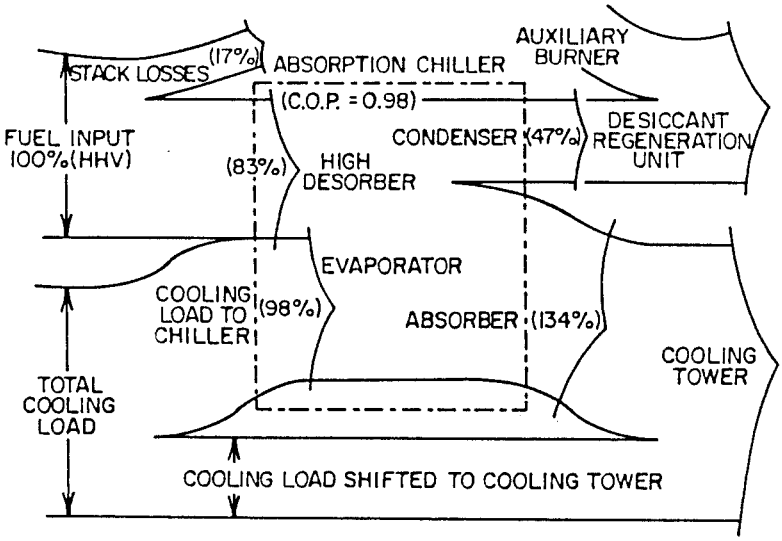
FIG. 4 is a schematic diagram of energy flows associated with the system of FIG. 3 having the double-effect lithium bromide/water absorption chiller refrigeration subsystem.

FIG. 4 shows a typical energy flow diagram for system 10. Driving energy from the fuel enters the system along with the building load as shown on the left side of FIG. 4. Energy leaves the system with the combustion exhaust, with the air leaving the desiccant regeneration unit, and with the air leaving the cooling tower. Of the total cooling load, some is rejected directly to the cooling tower from the desiccant conditioner (dehumidifier). It might be more accurate to call this unit a "conditioner" rather than a "dehumidifier" because the ventilation air may experience some sensible cooling along with the required latent load removal. The cooling tower may handle only a part of the total latent load, or it may take all of the load removed from the ventilation air. This will depend upon the ambient conditions and, to a lesser degree, on the control system algorithms employed.

The cooling load imposed upon the chiller will be matched by a fuel input, inversely related to the chiller cooling load by the chiller's coefficient of performance. FIG. 4 shows typical energy splits for the other elements in a double-effect $LiBr/H_2O$ absorption chiller. The energy rejection from the absorber is larger for the double-effect system than for the single-effect system. This limits the amount of energy recoverable to help with desiccant regeneration. Only the heat rejected from the condenser in an absorption subsystem can be elevated in temperature so as to be useful in the desiccant subsystem. As the chiller load decreases, extra regeneration heat will have to be generated by an auxiliary burner in the desiccant regeneration circuit. When the latent load is large at the design point, the auxiliary burner could be needed virtually all the time.

The model of FIG. 4 assumes that the firing rate of the chiller would be modulated to match the load. That would not always be the optimum situation, and interesting opportunities exist for on/off operation of the chiller and storage of chilled water and/or regenerated desiccant.

Figure 5:
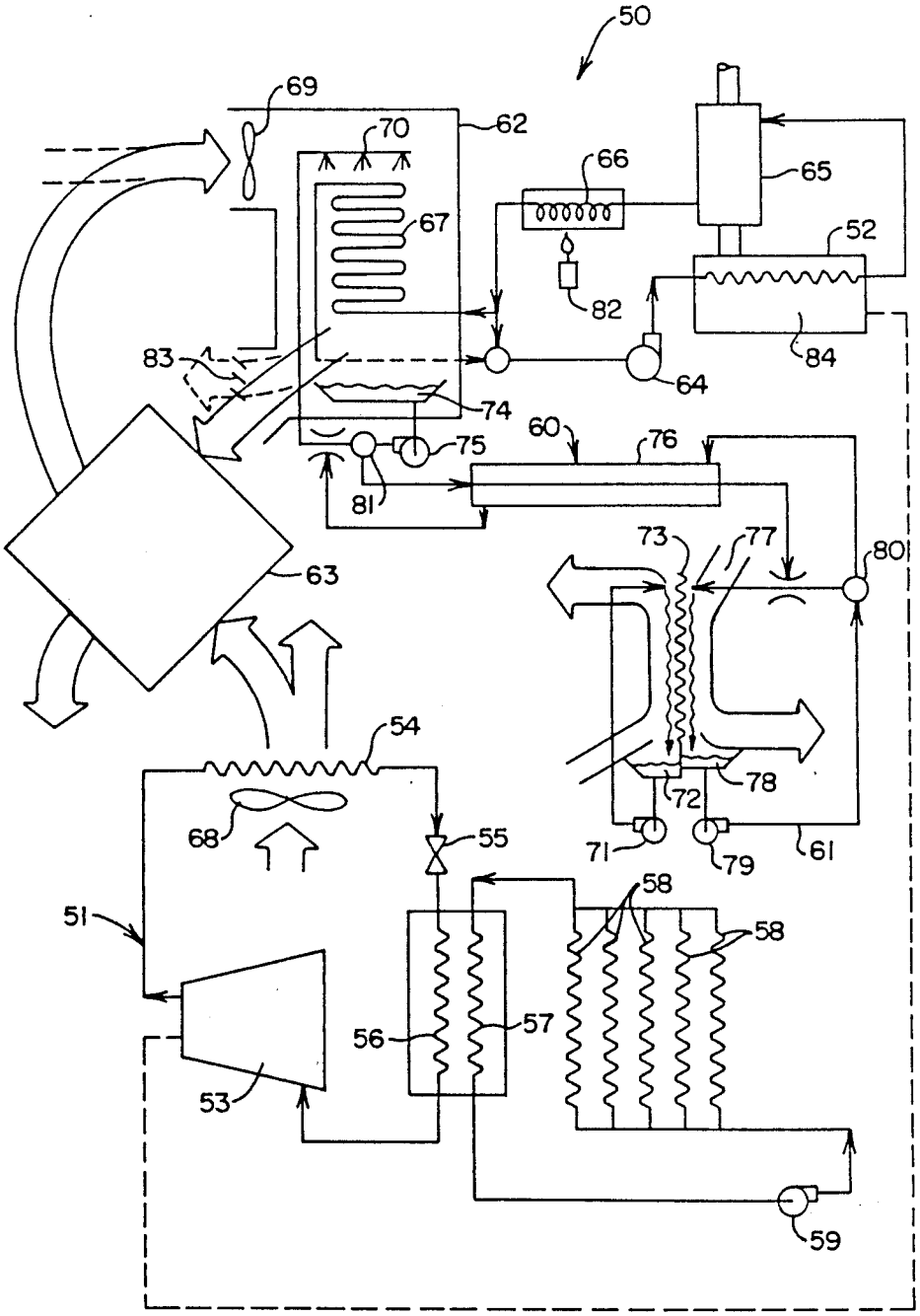
FIG. 5 is a schematic illustration of another embodiment of the apparatus and method of this invention having an engine-driven vapor compression refrigeration subsystem and a cooperating liquid desiccant dehumidification subsystem.

FIG. 5 schematically illustrates an alternate embodiment of a hybrid building air conditioning system to which this invention may have application. Such alternate system is designated generally as 50 and differs from system 10 in several important respects. First, the refrigeration subsystem 51 portion of system 50 is a vapor compression subsystem rather than an absorption chiller (refrigeration) subsystem. Subsystem 51 includes an internal combustion engine 52 that is preferably fueled by natural gas and that is mechanically coupled to conventional refrigerant compressor 53. The normally provided "Freon" type refrigerant in subsystem 51 circulates through the subsystem condenser coil 54, expansion valve 55, and evaporator coil 56 in a closed loop fashion. The sensible heat cooling load for the building enclosed space is transferred to evaporator coil 56 at the coil 57 included in the closed cooling loop further comprised of local convector radiators 58, circulating pump 59, and interconnecting lines. A liquid such as water or a water/ethylene glycol solution is normally circulated in the closed building cooling loop. Coils 56 and 57 are combined to comprise a conventional heat exchanger.

Secondly, the liquid desiccant dehumidifier subsystem 60 of hybrid building air conditioning system 50 is comprised of a triple conditioning dehumidifier 61 and a tower-type liquid desiccant regenerator 62.

Triple conditioning dehumidifier 61 functions much in the same manner of dehumidifier 15 of FIG. 3 except that cooling water is circulated by pump means 71 from the conditioner sump 72 to be sprayed so as to flow over one face of direct heat exchanger 73. The continuously circulated cooling water transfers heat to ambient air flowed through the water cooling tower "half" of conditioner/dehumidifier 61.

Relatively concentrated liquid desiccant solution 74 is flowed from the sump of desiccant regeneration tower 62 by pump 75 through desiccant solution heat exchanger 76 and spray onto the opposite "waterfall" face of direct heat exchanger 73. Building ventilation air induced from the ambient atmosphere at building ventilation air inlet 77 is "mixed" with the desiccant solution flowed over the face of direct heat exchanger 73 to reduce the moisture content of such ventilation air to the desired extent. Afterwards, the reduced relative humidity ventilation air is flowed to and intermixed with the building enclosure recirculated air as in the manner of FIG. 3 system. Thus, building enclosed space sensible heat loads are handled by vapor compression refrigeration subsystem 51 and latent water-removal heat loads are handled by liquid desiccant subsystem 60 to thereby obtain an improved total overall system coefficient of performance.

Note also that relatively dilute desiccant solution 78 is flowed by pump 79 through 3-way valve 80 to either the waterfall tower dehumidifier section of conditioner 61 or to sprayer 70 of regenerator section 62. Valve 80 may be made responsive to the sensed relative humidity condition in the building enclosed space receiving ventilation air from dehumidifier 61. Similarly, a 3-way valve 81 is provided to direct the flow of relatively concentrated liquid desiccant 74 from the sump of regenerator 62 to either heat exchanger 76 or to spray head 70. Valve 81 may be made responsive to the level of liquid desiccant solution in regenerator 62.

Regenerator 62 cooperates with air-to-air recuperator heat exchanger 63 as well as with the engine-driven refrigeration subsystem 51. Specifically, available "reject" heat for liquid desiccant regeneration is obtained by recirculating a liquid (e.g., ethylene glycol solution) by means of circulating pump 64 through the block 84 of engine 52, through a jacket provided around engine exhaust silencer of muffler 65, through heater coil 66, and through regenerator tower coil 67 and interconnecting lines. Further, ambient atmosphere air is flowed by fan 68 over refrigeration subsystem condenser component 54, through air-to-air recuperator 63, and by fan 69, through the regeneration chamber of regenerator 62, and again through recuperator 63 to atmosphere to effect moisture (water) removal from the relatively dilute liquid desiccant solution flowed from the conditioner 61 to the sprayer 70.

Figure 6:
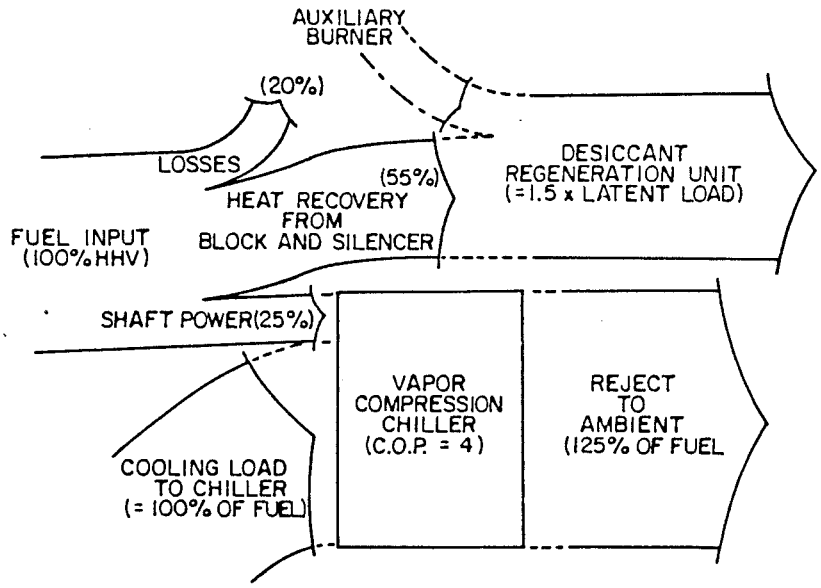
FIG. 6 is a schematic diagram of energy flows associated with the system of FIG. 5 having the vapor compression refrigeration subsystem compressor driven by an engine such as a natural gas fueled engine.

FIG. 6 shows and energy flow diagram for the engine-driven vapor compression/liquid desiccant-dehumidification system of FIG. 5. FIG. 6 is similar to FIG. 4 and the critical flows are very much like those for the double effect absorption chiller/liquid desiccant dehumidifier system previously illustrated.

Figure 7:
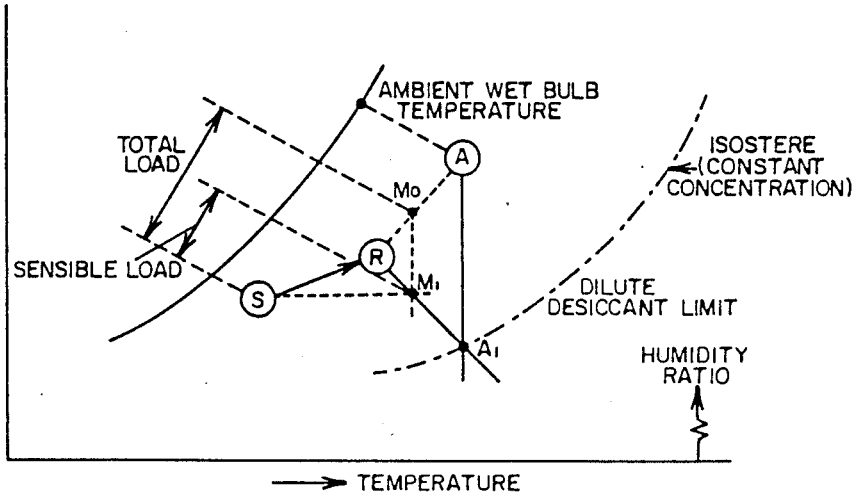
FIG. 7 is a psychrometric chart representation of the effects of building ventilation air dehumidification and mixing with building recirculated air.

One of the benefits of desiccant cooling systems is that no excess chilling capacity is needed as shown in FIG. 7. Isothermally dehumidifying the ventilation air from A to $A_1$ allows mixing of ventilation air at $A_1$ with return air at R to produce condition $M_1$. Only sensible cooling is needed to cool the air from $M_1$ to S and the evaporator supplying that cooling can operate at a warmer temperature than the conventional evaporator, creating the dew-point conditions as shown in FIG. 2, point $S_1$.

Even more importantly, the desiccant subsystem reduces the actual chilling capacity demanded of the conventional chiller by shifting some of the cooling load to a cooling tower. Simplistically, the hybrid system of this invention: accomplishes the latent load cooling with a cooling tower, sizes the expensive conventional chiller for only the sensible load, saves energy costs by recovering and using rejection heat from the smaller chiller for desiccant regeneration, reduces the size of the cooling tower from that required by a conventional chiller, and reduces the apparatus complexity otherwise required to accommodate the "off-design" system operating conditions.

Isothermal cooling of the ventilation air can easily take place as long as the liquid desiccant into which the moisture from the air is "condensed" is kept at a temperature near the ambient air temperature by cooling. Cooling tower water would be sufficiently cooler than the ambient temperature to accept the heat that must be removed from the liquid desiccant film as it contacts the air being dehumidified. By converting the ordinate of FIG. 7 from Humidity Ration to Vapor Partial Pressure, liquid desiccant constant concentration lines (isoteres) can be overlaid on the psychrometric chart. The isotere representing the limit of dilution of the desiccant by the absorbed moisture is shown in FIG. 7.

For the mass transfer of moisture vapor from the air to the desiccant solution to occur, the partial pressure of the vapor in the air must be greater than of the solution. The following Table 1 contrasts the desiccant and conventional dehumidification system features.

TABLE 1

| | | |
|---|---|---|
| MOISTURE REMOVAL | Liquid Drain | Vaporized to outside to regenerate desiccant |
| TEMPERATURE | Fixed dew point | Variable with solution concentration |
| BACTERIAL | Needs growth | Bacteriostatic |

TABLE 1-continued

| ACTIVITY | inhibitors | bacterioseptic |
|---|---|---|

Because desiccants can remove water vapor from the air without bringing the air to its dew point, neither an excessively cold temperature nor reheat is needed in a desiccant hybrid system. Since the desiccant is to be recycled, it must be regenerated by reevaporating the water it contains into an ambient airstream that carries away the moisture removed from the building. Though this is more complex than the simple liquid condensate drain of conventional system, significant advantages result. The condensate pool in a conventional system is an environment that promotes bacterial activity and growth and generally must be chemically treated for hygenic reasons. The liquid desiccant pool, on the other hand, is generally hostile to bacterial activity. For some strains of bacteria, only growth in inhibited; other strains are actually killed by the desiccant solution.

Figure 8:
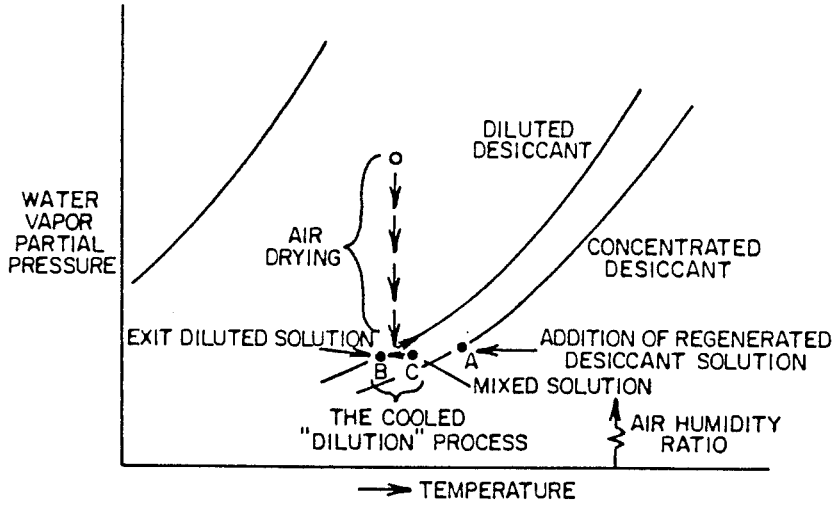
FIG. 8 is a psychrometric chart representation related to the process of liquid desiccant dilution during ventilation air dehumidification.

FIG. 8 provides additional detail of the dehumidification process. Concentrated (regenerate) desiccant solution is supplied to the dehumidifier at point A and mixed with solution from the sump beneath the dehumidifier at point B so that the combined flow at condition C is supplied to the top of the dehumidifier. The temperature range of this combined flow, which contacts the air to be dehumidified, is kept small by the cooling coils over which the desiccant flows as a falling film. Consequently there is little temperature potential for heat transfer to, or from, the air. The primary heat transfer occurs between the desiccant and the cooling coil as the "condensation" energy (released in the solution by the absorbed water) is removed. As stated earlier, cooling tower water would be capable of providing the cooling for the process in which the ventilation air is dehumidified. This was introduced in FIG. 7 and illustrated in FIG. 8.

Figure 9:
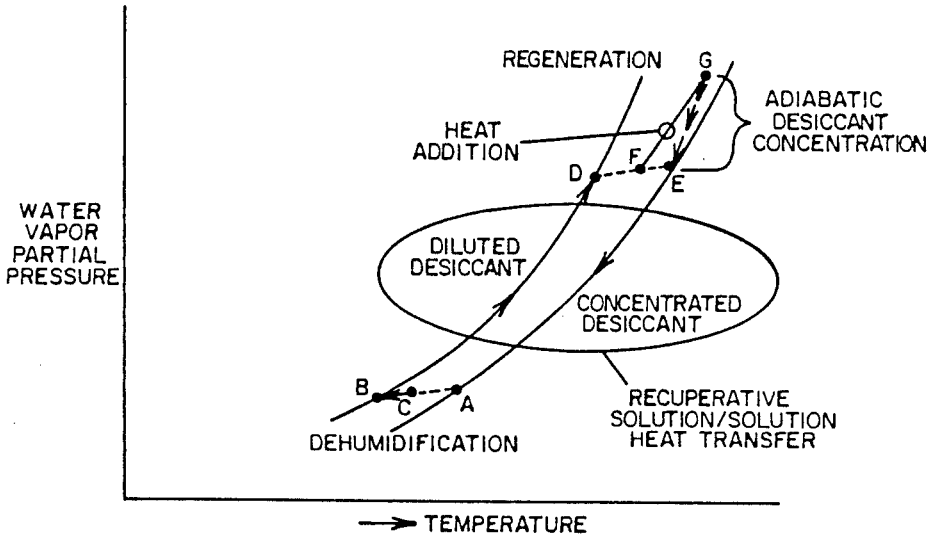
FIG. 9 is a psychrometric chart representation of the total liquid desiccant dehumidification desiccant dilution and concentration (regeneration) process.

FIG. 9 shows a simple representation of the three main desiccant cycle processes: dehumidification (conditioning), desiccant regeneration, and the solution heat exchange that links the two processes.

Figure 10:
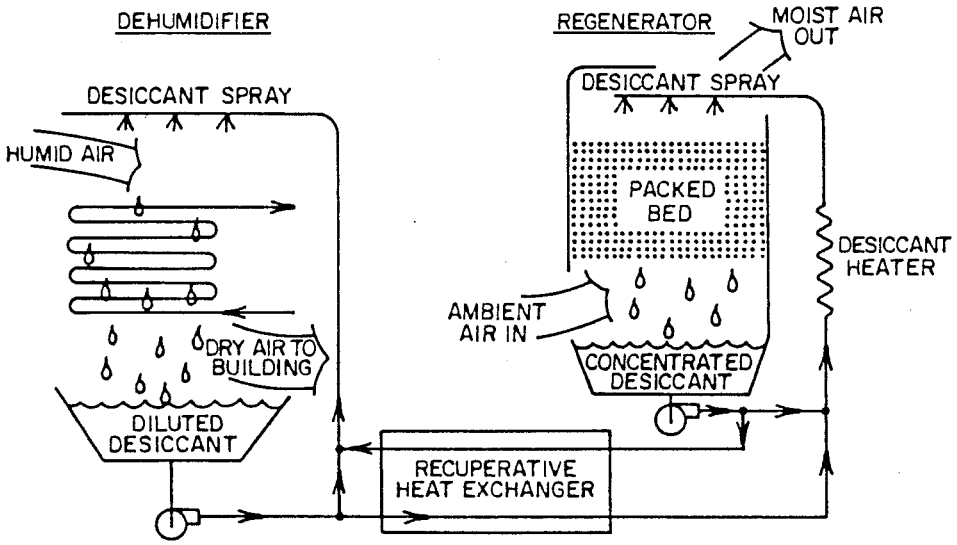
FIG. 10 is a schematic illustration of the apparatus and method of the invention liquid desiccant subsystem desiccant cycle.

FIG. 10 shows a schematic of the equipment associated with the processes traced on FIG. 9. As discussed above, desiccant at C flows over the cooling coils, decreasing in temperature, while at the same time the desiccant picks up moisture from the air and collects in the sump at condition B. The dilute desiccant, B., is recuperatively heated to condition D in the solution heat exchanger as the regenerated desiccant at E is cooled to point A. The mixed flows of desiccant at conditions A and B become the entering flow at C.

In the schematic shown in FIG. 10, the regeneration process is accomplished by a heat-mass transfer process different from those used in dehumidification. Instead of flowing the desiccant over a heat transfer surface as contact is made with the air, the liquid desiccant is heated first and then sprayed into a packed bed where it contacts the air. To reduce the temperature rise of the desiccant solution as it is heated, the flow rate is increased by recirculating desiccant from the sump at the bottom of the regeneration chamber. Because the energy required to evaporate the water must be first stored in the solution as sensible heat, dilute desiccant at D is mixed with regenerated desiccant at E, creating the increased flow of desiccant at F. This combined flow is heated from F to G and then sprayed onto the top of the packed bed.

As shown in the regeneration section schematic of such FIG. 10, the airflow is counter to the downward flow of desiccant solution. In this way, the water vapor partial pressure of the air is always less than that of the desiccant solution so the necessary mass transfer will occur. The process, G to E on FIG. 9, represents conversion of sensible heat of the solution into energy to vaporize the water and also to transfer heat to the air, which transports the water vapor out of the system to the ambient.

Figure 11:
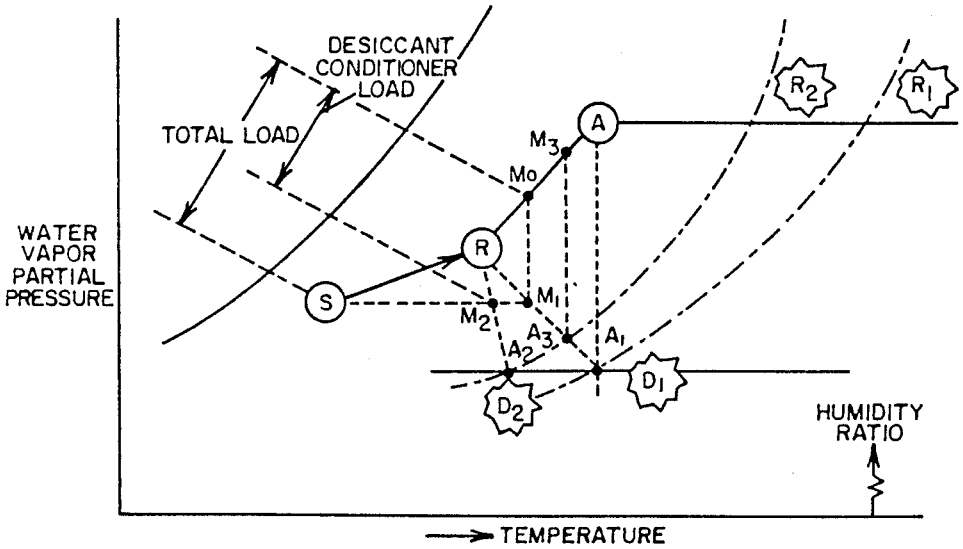
FIG. 11 is a psychrometric chart representation showing relationship between system dehumidification and regeneration temperatures.

FIG. 11 relates the temperatures in the dehumidification process with the temperatures in the regeneration process. When the ventilation air is dried sufficiently to accomplish the entire dehumidification function using cooling tower water alone, the regeneration temperature is significantly higher than ambient. This is shown as region $R_1$ on FIG. 11. Consequently, not all reject heat from a chiller cycle is, or can be made, hot enough to be usable. This is true for an absorption chiller using $LiBr/H_2O$ as the working fluid, because the absorber is severely limited by crystallization and cannot be operated in at a higher temperature. The condenser temperature, however, is not so limited and can be raised moderately without significant effect on the chiller COP.

Single-effect absorption chillers can be run with a hotter condenser with negligible concerns. To take advantage of the higher COP (about 1.0 instead of about 0.7), a double-effect chiller is preferred. Raising the condenser's temperature raises the pressure (to a smaller vacuum) but also raises the first-stage desorber (generator) pressure to values well above atmospheric. Both code and design limits restrict this pressure rise to less than one atmosphere gauge, thereby restricting the regeneration temperature to around 150° F. (66° C.). As a result, it may be desirable to reduce the regeneration temperature from the region represented by $R_1$ in FIG. 11 to the region, $R_2$. Following the limiting isotere down into the dehumidification region, $D_2$, brings the desiccant to a temperature lower than would be achievable with cooling tower water. To limit the chiller's maximum operating pressure, the dehumidification unit may be configured to combine both cooling tower and chiller cooling. Also shown on FIG. 4, damper 90 mixes a portion of the return air with the ventilation air as represented by point $M_3$ in FIG. 11. Isothermal dehumidification is shown in FIG. 11 to proceed to point $A_3$ on the more dilute limiting isotere that can be regenerated by heat in region $R_2$. Mixing of this combined air flow at $A_3$ with the remaining return air at R results in a total flow being supplied to the chiller evaporator at point $M_1$, as before. This process advantageously reduces the regeneration temperature without shifting significant load back to the chiller.

In FIGS. 3 and 7 the concept of pretreating the ventilation air was introduced; from FIG. 5, the concept of shifting system cooling load away from the absorption chiller to the cooling tower was introduced. In none of these cases was the impact of the actual building load explicitly dealt with. For FIG. 12, a simple design point parametric study was undertaken to show the general relationships between the sensible load characteristic for the building (line S-R in FIGS. 1, 2, and 7) and the size reduction that would be expected for the chiller. Since the chiller is expected to be the most expensive subsystem ($/equipment, ton), replacement of chiller capacity with the desiccant/cooling tower subsystem should reduce system first cost, ignoring economies of scale. Detailed cost comparisons have not yet been completed, but encouraging preliminary estimates show cost savings. Only the sensible load defines the size of the chiller, and only the latent load defines the size of the desiccant subsystem. Only if the specific cost of the desiccant subsystem based on the latent cooling load it handles is as high as that of the absorption system would no cost saving occur from this trade-off. The cooling tower is also significantly smaller in that it only handles the reject from the smaller absorber and the direct latent load instead of the sum absorber and condenser reject from the full-size chiller.

Figure 12:
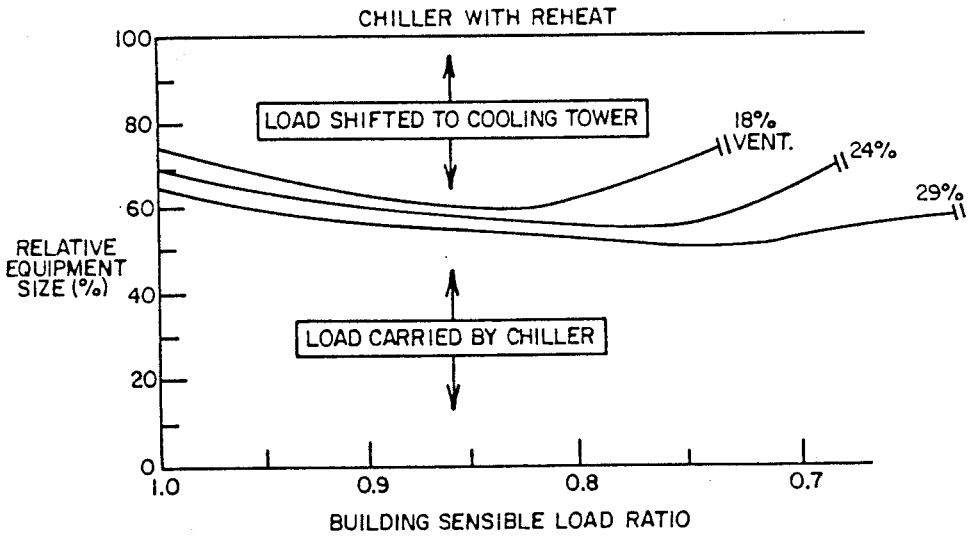
FIG. 12 illustrates the general relationships that exist in the invention as between the sensible and latent heat loads characteristic of an air conditioned building enclosure and size reductions that can be achieved in the system absorption chiller refrigeration subsystem.

As suggested in the previous discussion of FIG. 7, a given ventilation airflow would have an upper limit of latent load it could handle. FIG. 12 shows that a relatively modest ventilation flow of 18% would work well for buildings with sensible load ratios greater than 75%—latent loads less than 25%. A large number of commercial buildings of all sizes will fit into these limits.

Modest increases in the ventilation flow are shown to be quite beneficial, extending the load shift to the cooling tower into regions of higher latent loads. Ventilation increases of the order shown are not unreasonable and may be desirable as improved indoor air quality is sought.

Figure 13:
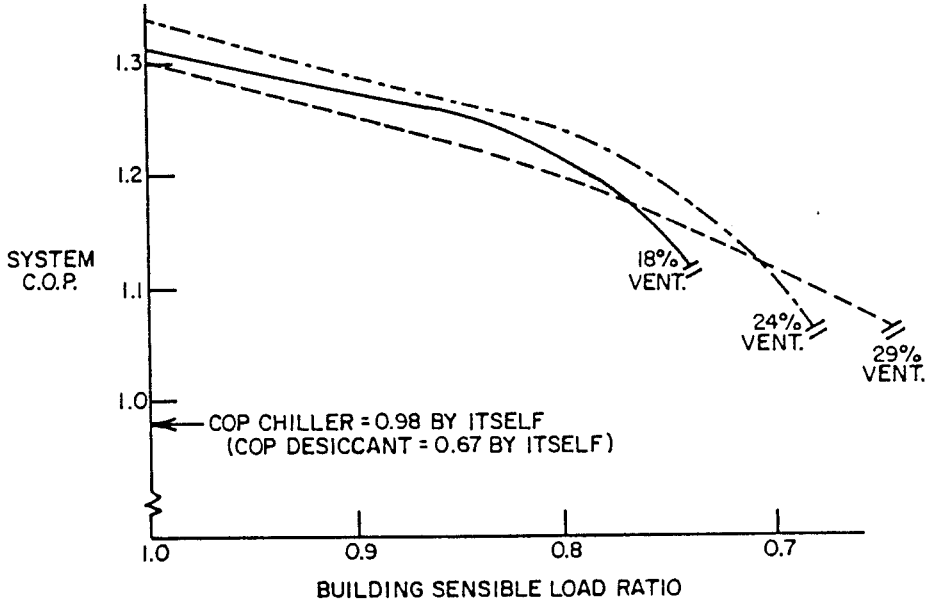
FIG. 13 illustrates overall system coefficient of performance improvements associated with the present invention and provides a basis for estimating or calculating design point fuel requirement reductions.

FIG. 13 shows that the hybrid approach of this invention combines two subsystems with individually modest energy efficiencies (absorption COP=0.98, and desiccant COP=0.67) to provide significantly improved overall COPs. From FIG. 13, a wide variety of installations would expect design point fuel reductions of at least 20%. The integrated seasonal energy reductions should be even greater. When combined with the potential for reduced first cost, the concept should lead to a new set of economically competitive options for the HVAC designer/specifier.

For an earlier summary of the more basic aspects if this invention see the paper "Dublsorb—A Universal Desiccant Hybrid Approach", Wilkinson, et al. in the publication ASHRAE TRANSACTIONS 1988, V. 94, pp. 1.

It is herein understood that although the present invention has been specifically disclosed with the preferred embodiments and examples, modifications and variations of the concepts herein disclosed may be resorted to by those skilled in the art. Such modifications and variations are considered to be within the scope of the invention and the appended claims.

I claim:

1. In a method of operating a hybrid air conditioning system comprised of a refrigeration subsystem and a liquid desiccant dehumidification subsystem having dehumidifier, cooling tower, desiccant regenerator, and air-to-air recuperative heat exchanger components, the steps comprising:

(a) extracting reject heat from said refrigeration subsystem to elevate the temperature of liquid desiccant solution flowed to said regenerator component for regeneration;

(b) mixing ambient air flowed through said air-to-air recuperative heat exchanger component with liquid desiccant solution heated by said refrigeration subsystem to increase the moisture and heat contents of said ambient air, and (c) flowing said heated ambient air in heat exchange relation or in by-pass relation to said air-to-air recuperative heat exchanger.

2. In a method of operating a hybrid air conditioning system comprised of a refrigeration subsystem and a liquid desiccant dehumidification subsystem having dehumidifier, cooling tower, desiccant regenerator, and air-to-air recuperative heat exchanger components, the steps comprising:

a. flowing a controlled mixture of relatively dilute desiccant solution and relatively concentrated desiccant solution to said dehumidifier component, and b. controlling the mixing of said desiccant mixed solution in response to a relative humidity condition detected in a building enclosed space receiving air conditioned by the hybrid air conditioning system.

3. The method defined by claim 2 wherein step (b) instead involves controlling the mixing of said desiccant mixed solution in response to a concentrated desiccant solution level contained in said desiccant regenerator component.

4. The method defined by claim 2 wherein step (b) additionally involves controlling the mixing of said desiccant mixed solution also in response to a concentrated desiccant solution level contained in said desiccant regenerator component.

* * * * *